US006125841A

United States Patent [19]

Boudreault

[11] Patent Number: 6,125,841

[45] Date of Patent: Oct. 3, 2000

[54] METHOD AND APPARATUS FOR COMBINED REMOVAL AND IN-SITU BIODEGRADATION OF GREASE MATERIAL FROM A KITCHEN VENTILATOR

[76] Inventor: Jean-Pierre Boudreault, 3839 Rachel, Montréal (Quebec), Canada, H1X 1Y7

[21] Appl. No.: 09/307,425

[22] Filed: May 10, 1999

Related U.S. Application Data

[63] Continuation-in-part of application No. 08/839,106, Apr. 23, 1997.

[51] Int. Cl.[7] ..... F24C 15/20

[52] U.S. Cl. ..... 126/299 D; 126/299 R; 55/DIG. 36; 454/53

[58] Field of Search ..... 126/299 D, 299 E, 126/312, 21 R; 454/49, 53, 54; 96/228, 229, 240, 234, 242; 55/DIG. 36

[56] References Cited

U.S. PATENT DOCUMENTS

| | | | |
|---|---|---|---|
| 4,066,064 | 1/1978 | Vandas | 126/299 E |
| 4,753,218 | 6/1988 | Potter | 126/299 E |
| 4,784,114 | 11/1988 | Muckler et al. | 126/299 D |
| 5,235,963 | 8/1993 | Strause | 126/299 E |
| 5,718,219 | 2/1998 | Boudreault | 126/299 E |
| 5,860,412 | 1/1999 | Way | 126/299 E |
| 5,874,292 | 2/1999 | McMinn, Jr. | 126/299 E |

*Primary Examiner*—Ira S. Lazarus
*Assistant Examiner*—Josiah C. Cocks
*Attorney, Agent, or Firm*—Swabey Ogilvy Renault

[57] ABSTRACT

Shots of grease biodegrading bacteria consortia are mixed with a flow of air which ascends through an exhaust hood. Preferably, the exhaust hood includes a filter device which comprises a narrowing passageway which is located immediately below a baffle filter thereby regularly distributing the air flow through the entire area of the baffle filter. The hood is constructed to cause a swirling motion to the air flow. Any grease which adheres to the filter is caused to be biodegraded

19 Claims, 4 Drawing Sheets

METHOD AND APPARATUS FOR COMBINED REMOVAL AND IN-SITU BIODEGRADATION OF GREASE MATERIAL FROM A KITCHEN VENTILATOR

CROSS-REFERENCE

This application is a continuation-in-part of application Ser. No. 08/839,106 filed on Apr. 23, 1997.

BACKGROUND OF THE INVENTION (a) Field of the Invention

This invention relates to a method and an apparatus for combined removal and biodegradation of grease material from a kitchen ventilator.

This invention relates specifically to an exhaust hood for separating and biodegrading grease particles. More particularly, the invention relates to a device which makes it possible to separate grease particles in air loaded with grease, produced by a cooking unit and to further biodegrade any grease that has not been drained away and that may remain on filters or deflectors used to separate it from air.

(b) Description of Prior Art

All kinds of devices are currently used to separate grease particles contained in air loaded with grease which is produced by a cooking unit. These devices include filters, baffles, deflectors, and the like, as well as combinations thereof. However, even though drain systems may be provided to remove excess grease from exhaust hoods and grease extractors, it remains that some grease remain therein and even some is cooked onto the filters, baffles, deflectors and the like.

On the other hand, known grease biodegrading bacteria consortia are sold in liquid form to be sprayed manually against some parts of exhaust hoods in an effort to biodegrade as much as possible of the grease which remain attached to the hood. It is not easy to have access to all the parts of the hood where some grease may be found on the one hand. On the other hand, it is just about impossible to introduce the right amount of bacteria consortia into the hood to provide a satisfactory treatment. If not enough is added, the treatment is not suitable. If too much is added, the excess is costly and will remain free in ambient air which is not normally acceptable.

U.S. Pat. No. 4,753,218 (Potter) discloses a hood including a baffle filter r and other baffle means, and a spray head associated with means for providing a continuous water wash including detergent, during the exhaust operation, to scrub away the grease particles that circulate through the hood. This idea is not satisfactory in that it is messy and does not contribute to a substantially complete removal of the grease particles which may have adhered to the inner parts of the exhaust hood.

It is therefore an object of the present invention to provide a system which automatically delivers an exact amount of grease biodegrading bacteria consortia to an exhaust hood so that any grease still remaining therein will be continuously biodegraded.

SUMMARY OF INVENTION

According to the present invention, there is provided an exhaust hood for separating and biodegrading grease particles, and means for mounting the exhaust hood above a cooking unit. The hood includes an exhaust fan to draw air loaded with grease produced by the cooking unit, into said hood. Means are mounted in the hood to separate grease particles contained in a flow of air which circulates through the hood while allowing substantially clean air to be expelled through the exhaust fan. The exhaust hood is associated with a supply of gas pressurized grease biodegrading bacteria consortia, an injection device mounted in the exhaust hood and arranged for feeding the gas pressurized bacteria consortia into a flow of air produced by the exhaust fan, the pressurized bacteria consortia thereby contacting the grease particle separating means, duct means connecting the supply of pressurized grease biodegrading bacteria consortia to the injection device, and control means effective to provide predetermined amounts of pressurized grease biodegrading bacteria consortia to the injection device, and to cause feeding of shots of bacteria consortia into the flow of air while the temperature inside the exhaust hood has reached a value within a range between about 10 and about 80° C., thereby allowing the biodegrading bacteria consortia to contact the separating means to biodegrade and substantially eliminate grease particles that may adhere thereto.

According to an embodiment, the control means are arranged to feed shots of bacteria consortia for a period of about 1 to 10 seconds, preferably about 2 to 5 seconds.

According to another embodiment, the control means comprise sensor means causing the injection device to feed said gas pressurized bacteria consortia into the flow of air when the latter is substantially free of grease particles obtained when a cooking operation is terminated. The sensor means may also operate to measure the temperature inside the exhaust hood and to adjust the quantity of bacteria to be injected.

The sensor means may also be arranged to feed pressurized bacteria consortia shortly before stopping the operation of the exhaust fan completely, for example the control means may be arranged to feed shots of bacteria consortia less than about 2 minutes before stopping the operation.

The separating means associated with the exhaust hood according to the invention preferably consist of a baffle filter.

The exhaust hood according to the invention preferably comprises a wedge shaped member mounted upwardly slanted in hood, the le filter being disposed in the wedge shaped member to define a passageway for the air loaded with grease which decreases from an entrance thereof until it becomes substantially flush with the baffle filter, said injection device feeding the bacteria consortia at the entrance.

Preferably, the wedge shaped member has an outer face defining the baffle, wings being provided longitudinally on both sides of the outer face, the wings being formed with slides along edges thereof, the baffle filter being engaged by the slides, the outer face defining an acute angle with respect to the baffle filter.

According to another embodiment, the wedge shaped member is provided with at least one grease drain at a downstream end of the passageway, a grease cup being provided to receive grease delivered through the drain.

According to yet another embodiment, the exhaust hood according to the invention comprises a plurality of wedge shaped members and baffle filters mounted side by side, each having its own bacteria consortia injection device, the injection devices being connected to a single supply of grease biodegrading bacteria consortia.

According to another embodiment, the exhaust hood according to the invention comprises means defining a path through the hood and deflector means provided therein to cause a swirling motion of the air loaded with grease along said path, the injection device being mounted to direct bacteria consortia into said path.

Finally, the exhaust hood according to the invention may comprise means to prevent radiation originating from the cooking unit to cook grease particles against the baffle filter.

The also relates to a method for removing grease material that is formed on grease separating means provided in an exhaust hood, the exhaust hood including an exhaust fan, which comprises providing a swirling motion to a flow of air loaded with grease particles which is produced by a cooking unit above which the exhaust hood is mounted, providing baffle filter means in the hood along the swirling flow, causing the swirling flow to move upwardly through the exhaust hood and trap grease particles by means of the baffle filter means. According to the invention there is provided a supply of gas pressurized grease biodegrading bacteria consortia, the temperature inside exhaust hood is allowed to reach a value within a range between about 10 and about 80° C., then shots of bacteria consortia are injected into the exhausted air, in a manner to contact the baffle filter means, thereby biodegrading and substantially eliminating grease particles that may adhere to the baffle filter means, duct and exhaust fan.

The method according to the invention may also comprises stopping operation of the cooking unit while continuously exhausting air substantially free of grease particles through the exhaust hood. It may also comprise injecting shots of bacteria consortia into the exhausted air shortly before stopping operation of exhaust fan, and injecting the shots less than 2 minutes preferably about 3 to 5 seconds before stopping the operation.

The method according to the invention may also comprise providing a sensor and operating the sensor to measure the temperature inside the exhaust hood and to adjust the quantity of bacteria to be injected.

The method according to the invention may also comprise providing a filter device including a baffle filter in the hood along the swirling flow, forming a decreasing passageway for the swirling flow below the baffle filter thereby regularly distributing the air loaded with grease throughout the entire area of the baffle filter.

BRIEF DESCRIPTION OF DRAWINGS

The invention is illustrated by means of the following drawings but is not restricted thereto. In the drawings.

DESCRIPTION OF PREFERRED EMBODIMENTS

Figure 1:
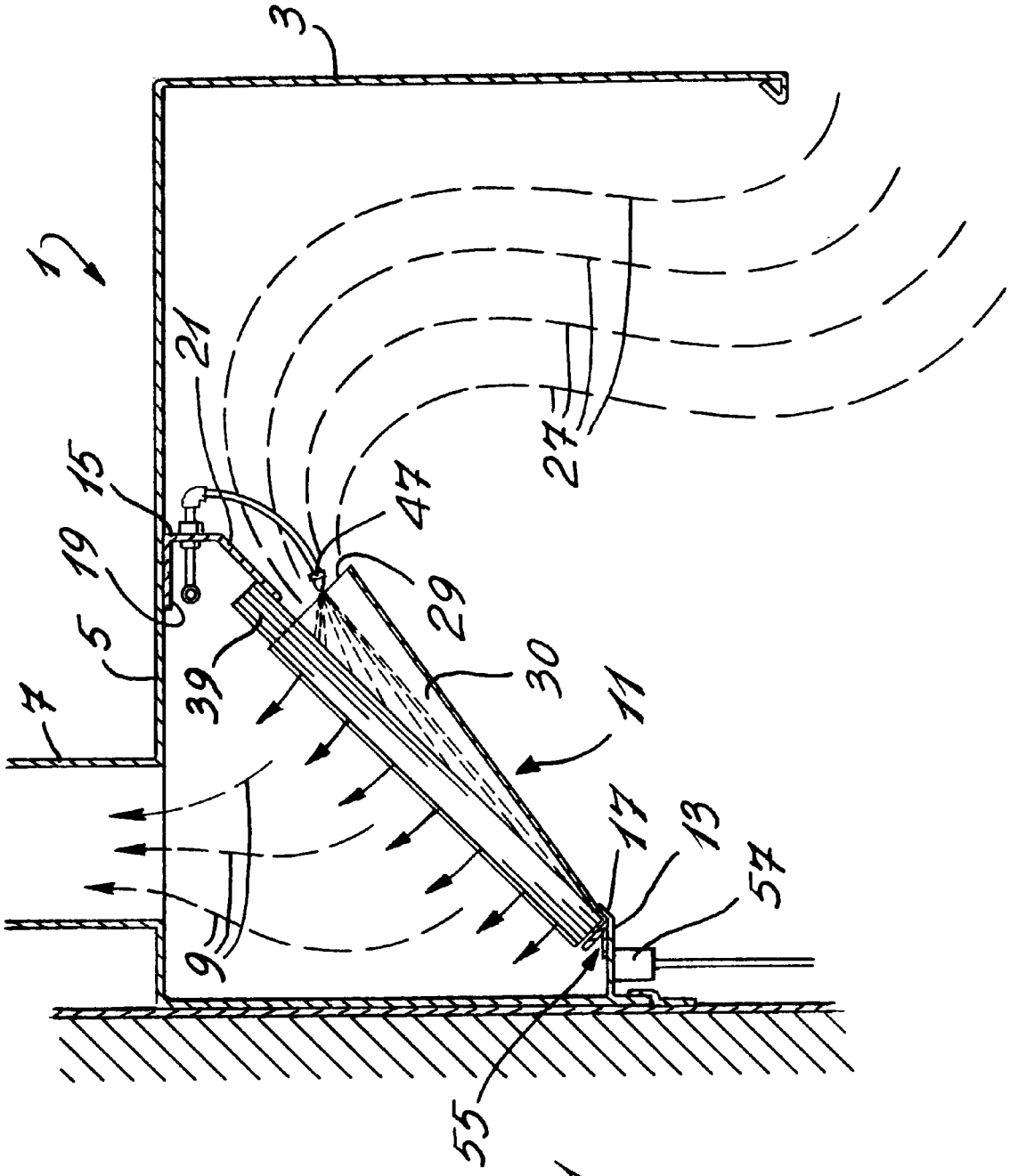
FIG. 1 is a vertical cross-section view of the device taken along line 1—1 of FIG. 3.
Figure 2:
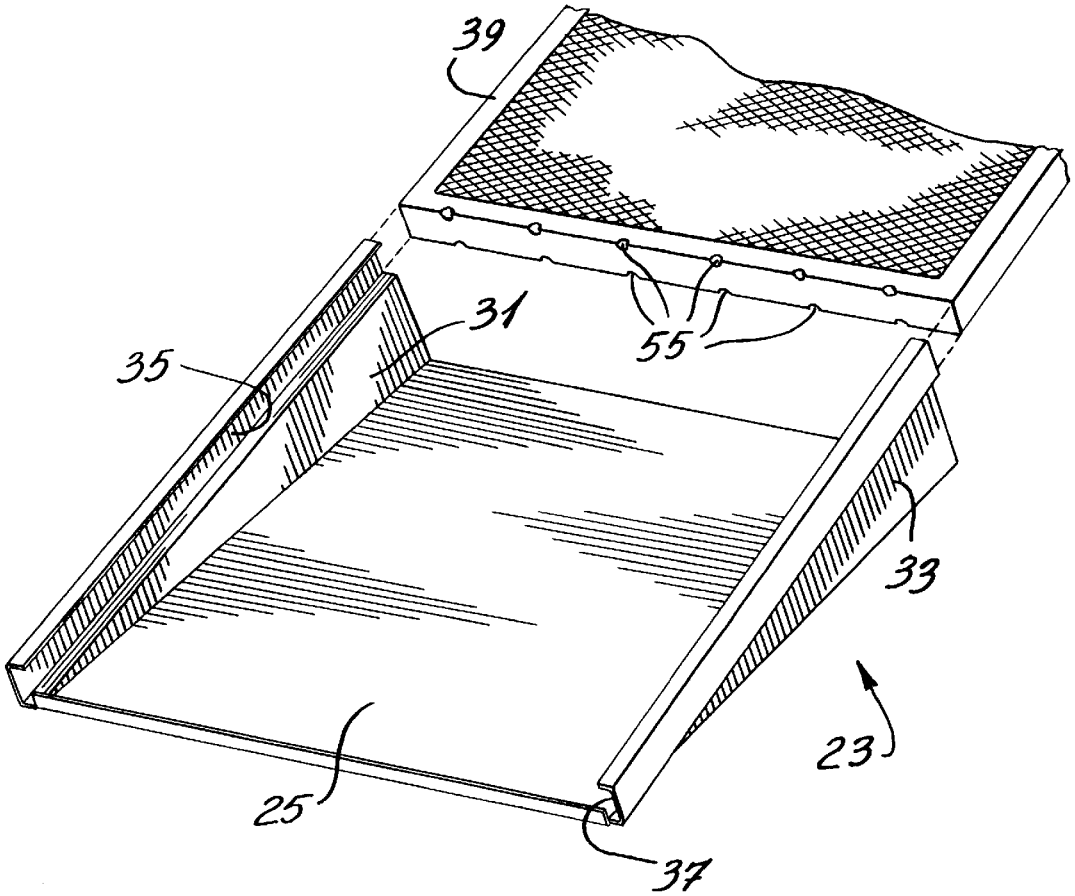
FIG. 2 is an exploded perspective view of a filter holder for the device illustrated in FIG. 1.

With reference to the drawings, more particularly FIGS. 1 and 2, it will be seen that the exhaust hood 1 which has been illustrated comprises a rectangular enclosure made of four vertical walls 3 and one horizontal top wall 5, and an exhaust duct 7 to lead filtered air to the outside in the direction indicated by arrows 9. A filter assembly 11 which will be more specifically described hereinbelow is mounted upwardly slanted as shown inside hood 1 by means of lower support bracket 13 and upper support bracket 15. It will of course be understood by one skilled in the art that those brackets 13, 15 may take any shape that are convenient provided mounting of filter assembly 11 can be achieved substantially as shown. More particularly bracket 13 consists of an L-member which is mounted against the rear wall of the enclosure, and is terminated at its outer end by a small support finger 17. Of course, the mounting of L-shaped bracket 13 against the rear wall of the enclosure can be achieved in any way well known by those skilled in the art.

With respect to support bracket 15, it consists of a rectangular trapezoidal member in which the perpendicular leg 19 is fixed against the horizontal face 5 of the hood while the other leg 21 which downwardly extends is used to support the upper end of filter 11.

Turning now to the filter per se, reference will also be made to FIG. 2 of the drawings wherein it will be seen that it consists of a wedge shaped member 23 which has a rectangular outer face 25, the latter defining a baffle which forces the air loaded with grease to be deflected in the direction indicated by arrows 27 before arriving at entrance 29 of filter assembly 11. Wedge member 23 also comprises wings 31, 33 on both longitudinal sides of wedge member 23. As shown, these wings 31, 33 are triangular for more convenience. At the top edge of triangular wings 31, 33, there are provided rectangular slides 35, 37 which are shaped to engage baffle filter 39 as particularly shown in FIG. 2 of the drawings.

Once wedge shaped member 23 and baffle filter 39 are assembled the filter assembly defines a passageway 30 for air loaded with grease which decreases from its entrance 29 until it becomes substantially flush with baffle filter 39 at the lower end thereof. This arrangement of a narrowing passageway allows the air and grease particles to be regularly distributed throughout the entire surface area of baffle filter 39 thereby providing a filter assembly which is much more efficient since the grease removal is not concentrated at a specific location of baffle filter 39. In addition to providing a swirling motion of the air loaded with grease particles towards entrance 29, the particular shape of the filter assembly 11, more specifically, outer face 25 of wedge member 23, enables to prevent the radiation originating from the cooking unit to literally cook some of the grease particles against baffle filter 39.

In practice filter assembly 11, including wedge member 23 and baffle filter 39, is made of galvanized steel, stainless steel or aluminum. Of course, any other suitable material can be used within the scope and spirit of the present invention.

Figure 3:
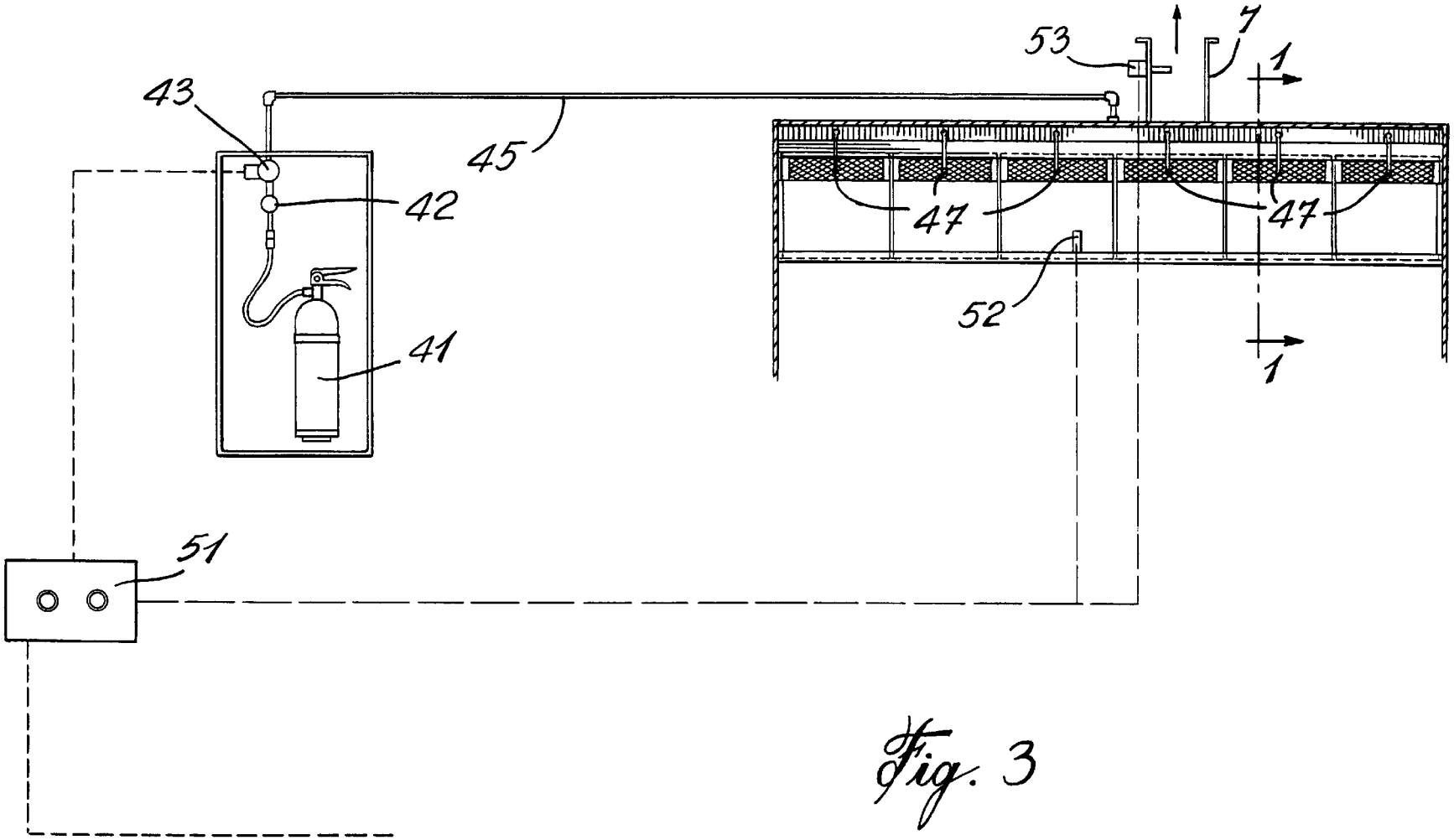
FIG. 3 is a front view of a system according to the invention incorporating six filter assemblies mounted side by side.

Turning now to FIG. 3, in conjunction with FIG. 1, it will be seen that, for convenience, more than one filter assembly 11 may be provided, such as six in the case illustrated in FIG. 3. It will further be seen that the exhaust hood which has been illustrated is connected to a gas (air or nitrogen) pressurized tank 41 containing a grease biodegrading bacteria consortia. Pressurized tank 41 is connected through pressure regulator 42 and valve 43 on the one hand to a plastic or copper pipe 45 leading to a spray nozzle 47 which is constructed to inject the bacteria consortia into the flow 27 of air loaded with grease circulating in passageway 29 defined by wedge member 23 and baffle filter 39. Mounting of the spray nozzle 47 is achieved through support bracket 21 as shown in FIG. 1.

The control for injecting a predetermined amount of bacteria consortia is made possible by the operation of the exhaust fan control station 51 which is calibrated to inject a predetermined amount of bacteria consortia from pressurized tank 41 preferably just before stopping the exhaust fan completely. A temperature sensor 52 is operatively connected to control station 51 to measure the temperature inside exhaust hood 1, and when this temperature reaches a level between about 10 and 80° C., the sensor directs control 51 to inject shots of bacteria. An air flow sensor 53 may also be disposed inside duct to adjust the flow of air which exits from the hood.

Any excess grease which has not reached baffle filter 39, or which has just flowed down towards the bottom of the triangular passageway 30 defined by outer face 25 and baffle filter 39, flows out through drain 55 into grease cup 57.

Figure 5:
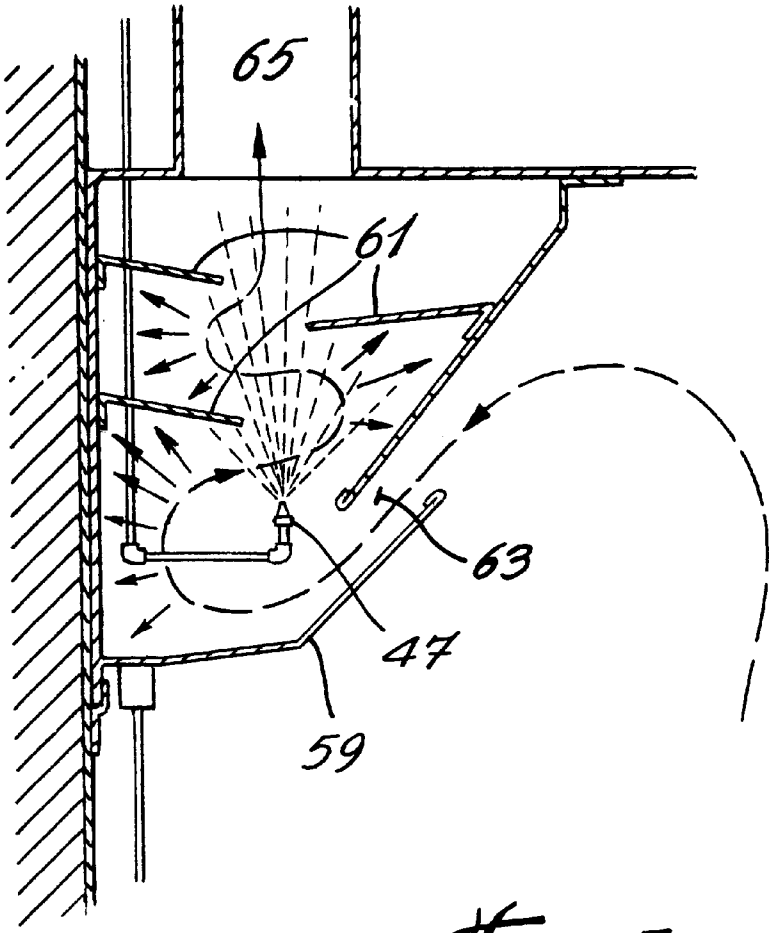
FIG. 5 is a vertical cross-section view of another alternative system.
Figure 4:
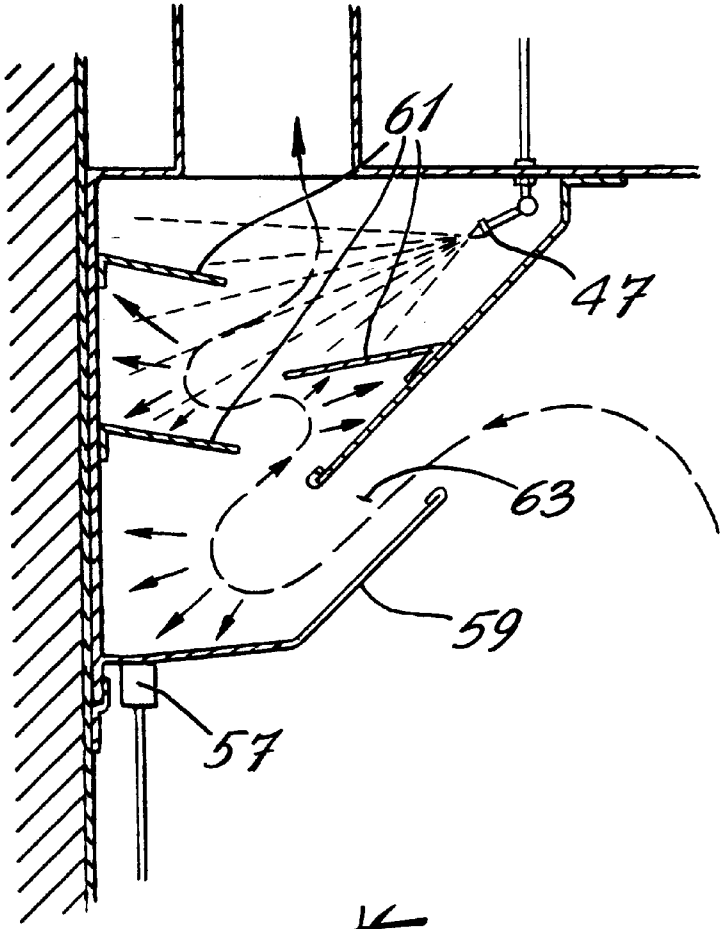
FIG. 4 is a vertical cross-section view of an alternative system according to the invention.

Turning now to FIGS. 4 and 5, the hood mainly includes a baffle 59 at the lower part thereof, and a plurality of deflectors 61 distributed along passageway 63 which leads to the exhaust duct 65. In FIG. 4, injection device (spray nozzle) 47 is mounted in the upper portion of the grease extractor and directs the bacteria consortia against the flow of air loaded with grease. Oppositely, with reference to FIG. 5, spray nozzle 47 is mounted in the lower part and directs the bacteria consortia along the flow of air loaded with grease.

Operation of the exhaust hood is obvious to one skilled in the art. It is merely sufficient to preprogram the desired quantity of bacteria consortia to be introduced into the exhaust hood, for biodegrading the grease found therein.

Of course, modifications are possible without departing from the scope and spirit of the present invention as long as they are provided by the appended claims.

I claim:

1. Exhaust hood for separating and biodegrading grease particles, and means for mounting said exhaust hood above a cooking unit, said hood including an exhaust fan to draw air loaded with grease produced by said cooking unit, into said hood, means mounted in said hood to separate grease particles contained in a swirling flow of air which circulates through said hood while allowing substantially clean air to be expelled through said exhaust fan, wherein said exhaust hood is associated with a supply of gas pressurized grease biodegrading bacteria consortia, a stationary injection device mounted in said exhaust hood and arranged for feeding said gas pressurized bacteria consortia into said swirling flow of air produced by said exhaust fan, said pressurized bacteria consortia contacting said grease particle separating means as a result of centrifugal effect, duct means connecting said supply of gas pressurized grease biodegrading bacteria consortia to said injection device, and control means effective to provide predetermined amounts of gas pressurized grease biodegrading bacteria consortia to said injection device, and to cause feeding of shots of bacteria consortia exclusively into said swirling flow of air when temperature inside said exhaust hood has reached a value within a range between about 10 and about 80° C., and while said exit fan is still in operation, and to allow said biodegrading bacteria consortia to contact said separating means to biodegrade and substantially disintegrate grease particles that may adhere thereto after said exhaust fan has ceased to operate without use of pressure or scrubbing.

2. Exhaust hood according to claim 1, wherein said control means are arranged to feed shots of bacteria consortia for a period of about 1 to 10 seconds.

3. Exhaust hood according to claim 2, wherein said period lasts about 2 to 5 seconds.

4. Exhaust hood according to claim 1, wherein said control means comprise sensor means causing said injection device to feed said gas pressurized bacteria consortia into said flow of air when the latter is substantially free of grease particles obtained when a cooking operation is terminated.

5. Exhaust hood according to claim 4, wherein said sensor means are arranged to feed said pressurized bacteria consortia shortly before stopping operation of said exhaust fan completely.

6. Exhaust hood according to claim 5, wherein said control means are arranged to feed shots of bacteria consortia less than about 2 minutes before stopping said operation.

7. Exhaust hood according to claim 1, wherein the separating means consists of a baffle filter.

8. Exhaust hood device according to claim 7, which comprises a wedge shaped member mounted upwardly slanted in said hood, said baffle filter being disposed in said wedge shaped member to define a passageway for said air loaded with grease which decreases from an entrance thereof until it becomes substantially flush with said baffle filter, said injection device feeding said bacteria consortia at said entrance.

9. Exhaust hood according to claim 8, wherein said wedge shaped member has an outer face defining said baffle, wings being provided longitudinally on both sides of said outer face, said wings being formed with slides along edges thereof, said baffle filter being engaged by said slides, said outer face defining an acute angle with respect to said baffle filter.

10. Exhaust hood according to claim 9, wherein said wedge shaped member is provided with at least one grease drain at a downstream end of said passageway, a grease cup being provided to receive grease delivered through drain.

11. Exhaust hood according to claim 9, which comprises a plurality of wedge shaped members and baffle filters mounted side by side, each having its own bacteria consortia injection device, the injection devices being connected to a single supply of grease biodegrading bacteria consortia.

12. Exhaust hood according to claim 1, which comprises means defining a path through said hood and deflector means provided therein to cause a swirling motion of said air loaded with grease along said path, said injection device being mounted to direct said bacteria consortia into said path.

13. Exhaust hood according to claim 9, which comprises means to prevent radiation originating from the cooking unit to cook grease particles against the baffle filter.

14. In a method for removing grease material that is formed on grease separating means provided in an exhaust hood, said exhaust hood including an exhaust fan, which comprises providing a swirling motion to a flow of air loaded with grease particles which is produced by a cooking unit above which said exhaust hood is mounted, providing baffle filter means in said hood along said swirling flow, causing said swirling flow to move upwardly through said exhaust hood to separate said grease particles by centrifugal effect, and to trap said grease particles on said baffle filter means, the improvement which comprises providing a supply of gas pressurized grease biodegrading bacteria consortia, allowing temperature inside said exhaust hood to reach a value within a range between about 10 and about 80° C., then injecting shots of said grease biodegrading bacteria consortia into the exhausted air while said exhaust fan is still in operation in a manner to be trapped by said baffle filter means where said grease particles have been trapped by said baffle filter means, stopping said fan and allowing said particles that may adhere to said baffle filter means, duct and exhaust fan to be biodegraded and substantially disintegrated.

15. Method according to claim 14, which comprises stopping operation of said cooking unit while continuously exhausting air substantially free of grease particles through said exhaust hood.

16. Method according to claim 14, which comprises injecting shots of bacteria consortia into the exhausted air shortly before stopping operation of said exhaust fan.

17. Method according to claim 16, which comprises injecting said shots less than 2 minutes before stopping said operation.

18. Method according to claim 14, which comprises providing a sensor and operating said sensor to measure temperature inside the exhaust hood and to adjust the quantity of bacteria to be injected.

19. Method according to claim 14, which comprises providing a filter device including a baffle filter in said hood along said swirling flow, forming a decreasing passageway for said swirling flow below said baffle filter thereby regularly distributing said air loaded with grease throughout the entire area of said baffle filter.

* * * * *